United States Patent [19]

Mroz

[11] Patent Number: 4,658,734

[45] Date of Patent: Apr. 21, 1987

[54] INDEPENDENT SUSPENSION RAILWAY BOGIE

[76] Inventor: Joseph Mroz, 2572 Montgomery Street, Montreal, Canada, H2K 2S4

[21] Appl. No.: 710,368

[22] Filed: Mar. 11, 1985

[51] Int. Cl.[4] ..... B61F 3/16; B61F 5/04; B61F 5/30

[52] U.S. Cl. ..... 105/169; 105/180; 105/196; 105/199.3; 105/218.2

[58] Field of Search ..... 105/133, 136, 157 R, 105/169, 172, 175 R, 180, 182 R, 196, 199 C, 199 S, 199 R, 199 CB, 218 A

[56] References Cited

U.S. PATENT DOCUMENTS

| | | | |
|---|---|---|---|
| 431,936 | 7/1890 | Crow | 105/199 C |
| 825,723 | 7/1906 | Hatcher | 105/199 CB |
| 1,717,058 | 6/1929 | Miller | 105/199 C X |
| 2,097,968 | 11/1937 | Edmunds | 105/180 X |
| 2,473,714 | 6/1949 | Krotz | 105/182 R |
| 3,939,779 | 2/1976 | Pringle | 105/182 R X |
| 3,946,676 | 3/1976 | Mackaness et al. | 105/199 C X |
| 4,337,707 | 7/1982 | Brouwer | 105/199 CB X |
| 4,362,109 | 12/1982 | Panagin | 105/169 X |

FOREIGN PATENT DOCUMENTS

| | | | |
|---|---|---|---|
| 0462041 | 5/1935 | United Kingdom | 105/199 R |

*Primary Examiner*—Robert B. Reeves
*Assistant Examiner*—Scott H. Werny

[57] ABSTRACT

A bogie for use with a railway wagon, comprising a rigid horizontal frame adapted to be vertically pivoted to the underside of the wagon by a central vertical pivot, also with the interposition of a large diameter ball bearing assembly, co-axial with the pivot and positively maintaining the frame parallel to the bottom of the wagon. Rail-engaging wheels are each supported below the frame by an independent suspension assembly. Each of the latter comprises a pair of lever arms extending on both sides of the associated wheel and pivoted at one end to the frame and rigidly interconnected at their opposite ends by a cross-member. The wheel is rotatably carried by the intermediate portions of the two arms. An elastic suspension member extends vertically between the frame and the cross-member. The main parts of the bogie are of welded box-like construction formed of metal plates. The wheels can be easily dismounted for repair or replacement.

12 Claims, 13 Drawing Figures

INDEPENDENT SUSPENSION RAILWAY BOGIE

FIELD OF THE INVENTION

The present invention relates to bogies for railway vehicles.

BACKGROUND OF THE INVENTION

The wheels and structural elements of presently-used railway bogies are prone to rapid wear, due to their rigid wheels and axle construction. It is desirable to provide a railway bogie, the wheels of which are provided with an independent suspension. U.S. Pat. No. 4,362,109 dated Dec. 7, 1982, in the name of Romano Panagin and entitled: >>RAILWAY VEHICLE TRUCKS<<, describes a bogie with independent wheel suspension. However, in this system, the suspension springs are mounted in register with the wheel axes and, therefore, must have a considerable suspension force and, moreover, they are directly connected to the underside of the wagon, whereby they are subjected to bending forces when the truck rotates about its vertical axis.

OBJECTS OF THE INVENTION

The general object of the invention is to provide a bogie for railway wagons,having improved independent suspension means for each of the railway wheels, so as to maximize traction on the railroad tracks and also minimize wear of the moving parts.

Another object of the invention is to provide a bogie of the character described, in which the lever arms supporting each wheel are arranged on each side of the wheel and are interconnected at their free ends by a cross-member transversely extending beyond the wheel and supporting the suspension spring, the arrangement resulting in a minimum of torsion on the arm axes, due to the balanced construction of the system.

Another object of the invention is to provide a bogie of the character described, in which the structural elements are made of steel plate and welded construction for improved rigidity and less-expensive construction, as compared to cast steel construction.

Another object of the invention is to provide a bogie of the character described, in which each wheel is directly connected to a driving motor.

SUMMARY OF THE INVENTION

The bogie of the invention comprises a rigid horizontal frame adapted to be centrally pivoted to the underside of the wagon by means of a vertical pivot and having means for positively maintaining the frame parallel to the plane of the wagon underside during its rotation. Rail-engaging wheels extend below the frame and separate suspension means, one for each wheel, interconnects the latter to the frame. These suspension means include for each wheel a pair of spaced-opposite supports downwardly projecting from the frame, a pair of lever arms extending on both sides of a wheel, with their intermediate portion carrying the wheel axle, one end of the lever arms being pivoted to the support and the other end of said lever arms being rigidly interconnected by a cross-member and an elastic member generally vertically extending between the frame and the cross-member. Preferably, the means restraining the frame to pivot in a plane parallel to the underside of the wagon, includes a large diameter ball bearing assembly co-axial with the vertical pivot and sandwiched between the wagon underside and the top of the frame. Preferably, the frame, the supports and the lever arms are fabricated of steel plates suitably bent and welded. The bogie construction can be applied to a four-wheel or to a six-wheel bogie. In the latter case, for longer wagons; also wagons adapted to carry a heavier load. In the latter case, the two central wheels are free of any guiding flange. The suspension springs may be associated with shock absorbers, if desired. The system may include a disc brake assembly and also each wheel may be associated with its own driving motor. The various moving parts of the bogie may be easily and quickly disassembled to replace worn-out or defective parts.

DETAILED DESCRIPTION OF THE PREFERRED EMBODIMENTS

Figure 1:
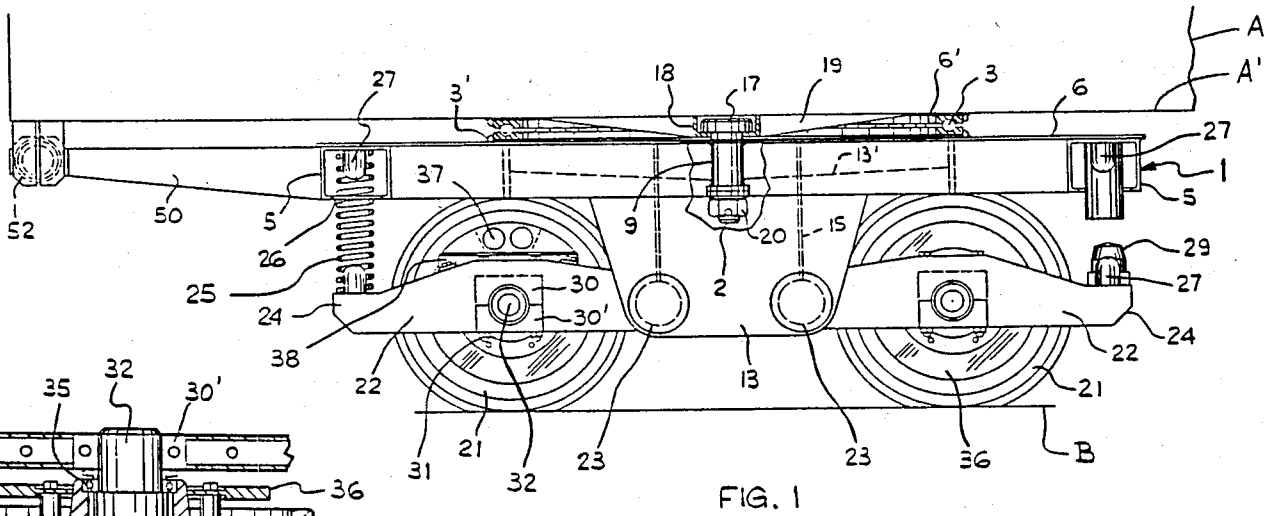
FIG. 1 is a side elevation of a four-wheel bogie in accordance with the invention.
Figure 2:
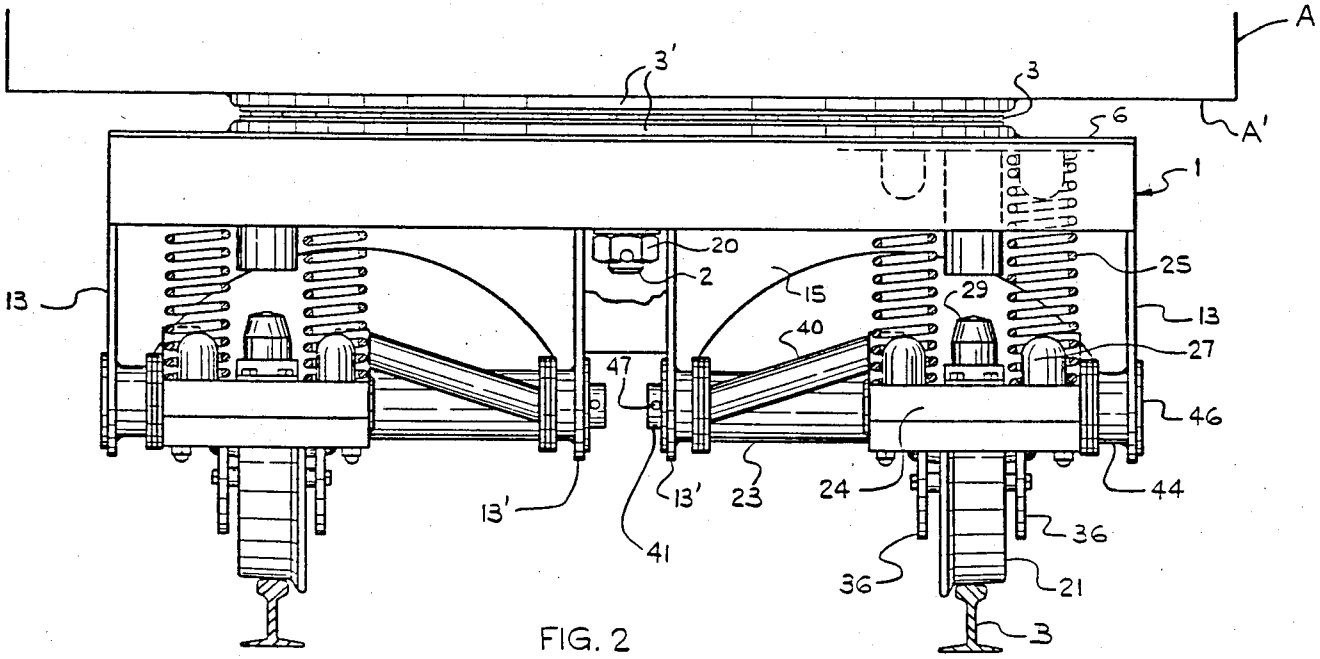
FIG. 2 is a left end elevation of the same.
Figure 3:
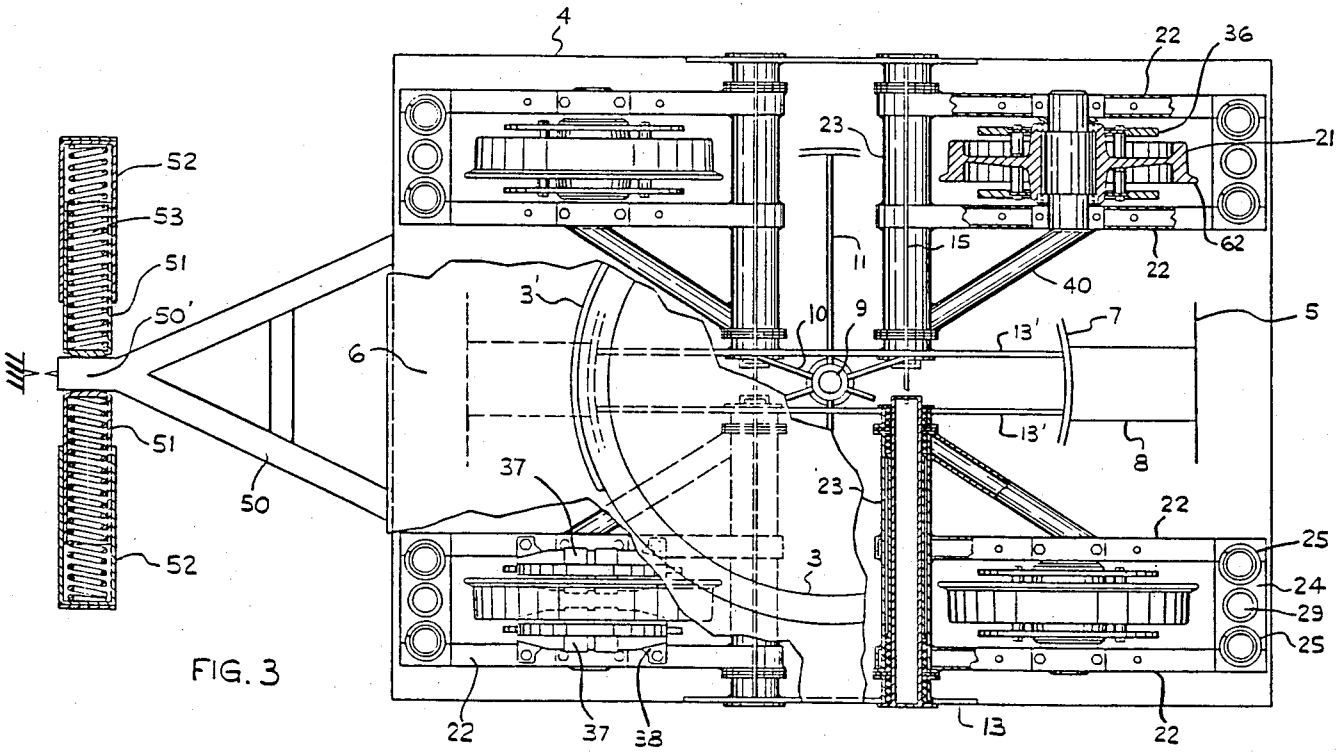
FIG. 3 is a top view, partially in plan section of the bogie frame, of the bogie assembly.
Figure 7:
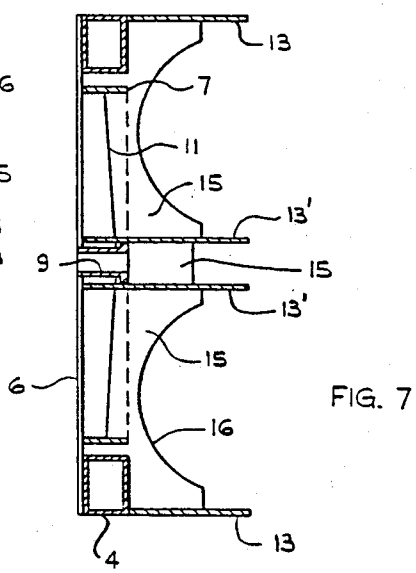
FIG. 7 is a vertical cross-section, taken along line 7—7 of FIG. 5.
Figure 5:
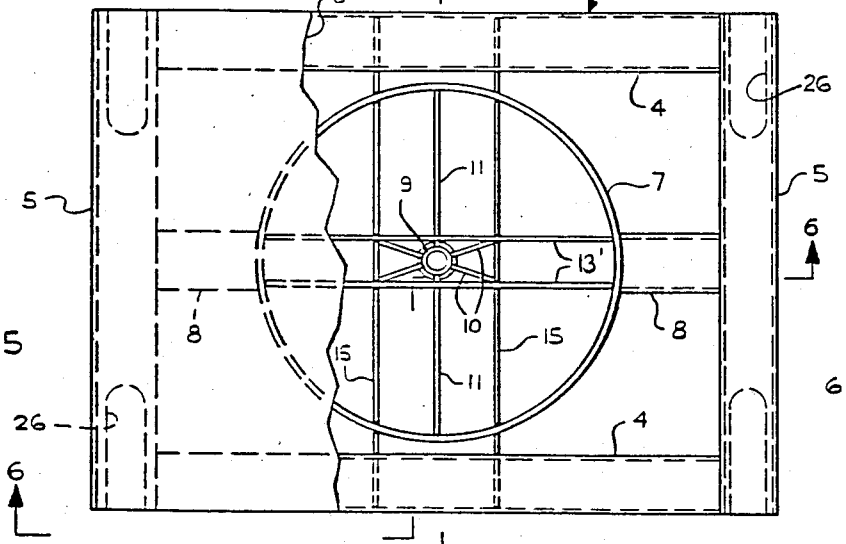
FIG. 5 is a plan section, partially cut away, of the bogie frame.
Figure 6:
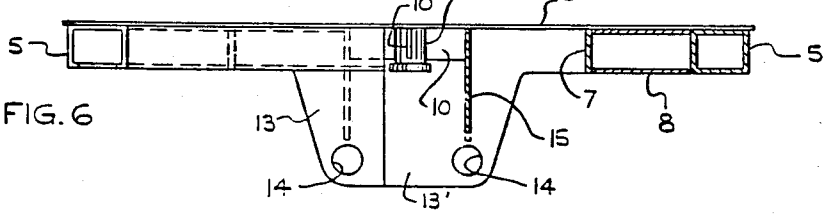
FIG. 6 is a side elevation, partially in vertical section and taken along line 6—6 of FIG. 5.

As shown in FIGS. 1, 2, and 3, a rigid rectangular frame 1 is pivotally secured at its center to the underside A′ of a railway wagon A by means of a vertical pivot pin 2 for pivotal movement in a plane generally parallel to the underside of wagon A, there being interposed between said wagon underside A′ and the top of frame 1 a large diameter ball bearing assembly 3 co-axial with pivot pin 2. Frame 1 is of tubular construction, made of steel plates, bent to form and welded. As shown in FIGS. 5, 6, and 7, the frame includes side tubing members 4 and transverse tubing members 5 welded together at their ends, preferably covered by a rectangular plate 6, which is not essential. The ball bearing 3 is sandwiched with elastomeric sheet material 6′ and kept in place with rings 3′ which are welded to plate 6 and wagon underside A′. A circular ball bearing-supporting web 7, adapted to vertically register with a lower race of ball bearing assembly 3, is fixed to the underside of plate 6 and is connected to the center of the end tubings 5 by means of short tubular members 8. A central pivot sleeve 9, for rotatably receiving the pivot pin 2, is rigidly secured to and extends through the center of plate 6 and is reinforced by reinforcing web members 10 and 11, the latter extending transversely of the frame 1 to the ball bearing-supporting web 7. As shown in FIGS. 6 and 7, a pair of downwardly-protruding supports 13' extend longitudinally of the frame 1 between the ball bearing-supporting web 7 and on each side of sleeve 9, and also the outside of tubing members 4 define at their center downwardly-protruding supports 13. The supports 13, 13' are provided with a pair of horizontally-aligned holes 14. These supports 13, 13' serve to carry the individual wheel assemblies of the bogie. Above each hole 14 is welded an upright reinforcing transverse plate 15, having a semi-circular lower concave edge 16 and welded to the top plate 6 and to the external support 13 and inner support 13'. As shown in FIG. 1, the pivot pin 2 has a head 17, which is retained within a casing 18 fixed to the underside A' of the wagon A and reinforced by radially-outwardly tapering webs 19, also fixed to said underside. The head 17 of pivot pin 2 could be made accessible through a normally-closed hole in the floor of the wagon. The lower end of pin 2 is threaded to receive a nut 20, so as to easily disconnect the bogie from the wagon.

Figure 8:
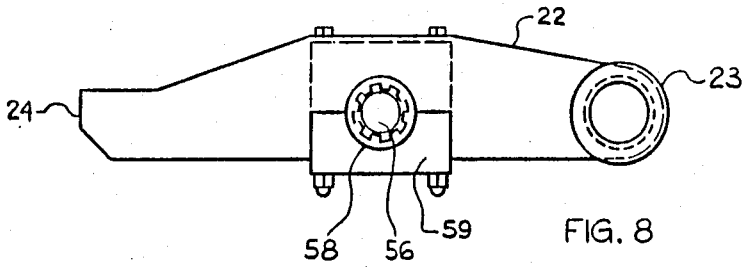
FIG. 8 is a side elevation of a wheel-supporting lever arm.
Figure 9:
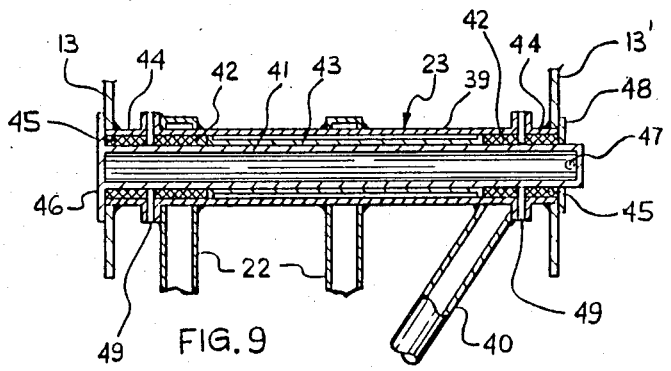
FIG. 9 is a section showing the removable mounting of the lever arm assembly to the bogie frame.

Each of the four rail-engaging wheels 21 carried by the bogie in accordance with FIGS. 1 to 8, is carried by the intermediate portion, preferably the center portion, of a pair of lever arms 22, each having an inner end pivotally connected to the supports 13, 13' by a pivotal assembly 23, shown in more details in FIG. 9, the opposite end of the pair of lever arms 22 being rigidly interconnected by a cross-member 24, on top of which bear a pair of compression coil springs 25, which extend upwardly through an opening 26 made in the lower wall of the end tubular members 5 to bear against the top wall of said tubular members. The coil springs are each opposite a lever arm 22 and simply rest on the cross-member 24 and against the top wall of the tubular members 5 being guided in said position by studs 27 fixed to the respective members 24 and 5 and extending within the coil springs. A pneumatic suspension could be used instead of coil springs.

Figure 4:
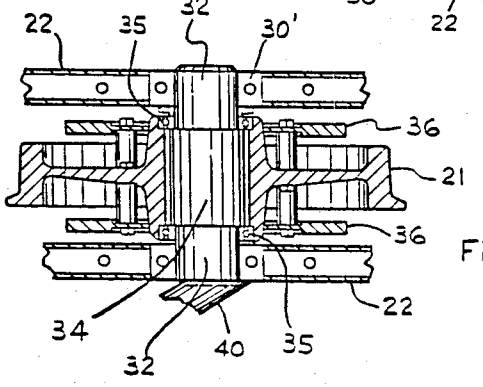
FIG. 4, seen on the first sheet of drawings, is a partial horizontal plan section on an enlarged scale, of the wheel assembly seen on the right upper corner of FIG. 3.

A tubular stop 28, made of steel, is fixed to the top of tubing member 5 in between the two upper spring-guiding studs 27 and is disposed in vertical register with the central upwardly-extending rubber stop 29 delimiting upward movement of the lever arms 22 when abutting the steel stop 28. The stops 28, 29 are in the vertical plane containing the wheel 21. The pair of lever arms 22 are of tubular construction and each carries a split pillow block, made of upper section 30 and lower section 30'. Upper section 30 is fixed to the lever arm 22, while the lower section 30' is removably retained to upper section 30 by bolts and nuts 31 and tightened around the respective reduced-diameter ends 32 of a wheel axle 34. The wheel 21 is freely rotatably mounted on the wheel axle 34 with the interposition of a pair of ball bearings 35, as shown in FIG. 4. To the web of the wheel are fixed a pair of brake discs 36 disposed on both sides of the wheel and each engageable on both faces by brake pads, generally shown at 37, of conventional construction, and mounted on top of the respective lever arms 22 by means of brackets 38 (see FIG. 1).

The wheel 21 can be readily dropped from the two lever arms 22 by unscrewing the bolts and nuts 31 and to release the lower pillow block section 30'. The pivotal assembly 23 is more clearly shown in FIG. 9 and in the lower right corner of FIG. 3. The inner ends of the two lever arms 22 are perforated to slidably receive an outer tube 39 welded to the lever arms. This outer tube 39 extends inwardly from the pair of lever arms towards the center of the bogie, that is towards the inner support 13'. At the inner end of the outer tube 39, there is welded a tubular diagonally-extending reinforcing brace 40, which is secured at its other end to about the center of the inner one of the two lever arms 22. This outer tube 39 is rotatably supported on a tubular inner pin 41 by the interposition of bushings 42 made of hard elastomeric material and disposed in register with the outer one of lever arms 22 and with the end of the brace 40, respectively, these two bushings 42 being kept in position by a spacer tube 43 immediately surrounding the tubular pin 41. A short metallic sleeve 44 is welded, or otherwise secured, within the hole 14 of the respective supports 13 and 13' and extends towards each other and they support the tubular pin 41 through the interposition of second bushings 45, made of the same material as bushings 42. The elastomeric bushings 42, 45 are designed to more efficiently absorb shocks at the level of the pivotal connection of the lever arms 22 to the frame 1. However, they could be replaced by metallic, such as bronze, bushings, for railway freightcarrying wagons.

The tubular pin 41 is removably inserted within the bushings 42, 45 and has a head 46 at its outer end, while its inner end is provided with registering transverse holes 47 for receiving a removably locking member, such as a cotter pin. A perforated plate 48 is applied to the inner support member 13' and freely surrounds the tubular pin 41, so as to retain the second bushing 45. The pairs of bushings 42, 45, and also the short sleeves 44 and the outer tube 39, are separated by spacer washers 49 which may have a variable thickness, so as to easily transversely align the associated wheel 21 with respect to the other wheels longitudinally of the frame 1, so as to properly engage the rails B on which the wheels 21 will ride. It is seen, by simply removing the cotter pins engaging the holes 47, that the tubular pin 41 may be removed outwardly of the bogie and the whole wheel assembly, with its lever arms, may be disconnected.

As shown in FIGS. 1 and 3, the frame 1 is preferably resiliently maintained in longitudinal alignment with the overlying wagon A by means of an A-shaped frame extension 50 fixed to the center of one of the end tubing members 5 horizontally extending and having its outer end 50' disposed between a pair of aligned tubular plungers 51, which telescopically engage tubes 52 fixed to the underside A' of the wagon A, the plungers 51 being biased towards the frame extension 50 by compression coil springs 53 disposed within the plungers 51 and tubes 52. Because the frame 1 supports the wagon A, through the larger diameter bearing assembly 3, a great lateral stability is imparted to the wagon A. Bearing assembly 3 also serves to resist the horizontal stresses between wagon A and frame 1. Because the suspension springs 25 engage frame 1, and not the underside of the wagon A, they are not bent when the bogie rotates with respect to the wagon. Because these springs 25 are mounted at the outer end of lever arms 22 and, therefore, beyond the wheels 21 and about twice the distance of the wheel axle from the pivotal assembly 23, these springs need only about half the compression strength of the springs 76, shown in U.S. Pat. No. 4,362,109, resulting in a much smoother suspension. Because the resultant force of the two compression springs 25 is exerted in the vertical plane of the wheel 21, there is no torsion exerted by lever arms 22 on the pivotal assembly 23. Disassembly of the wheel 21 from the lever arms 22, and also of the latter from the frame, is easily accomplished, as previously noted. The spacer washers 49 enable in a simple manner to longitudinally align the respective pair of wheels on each side of the bogie. Each wheel is supported by the lever arms, on each side of the wheel, by respective bearing assemblies. Therefore, the wheel axle is not subjected to torsion. The tubular construction of the frame 1 and lever arm assemblies 22 results in very stiff parts and yet of inexpensive construction. Because the brake discs 36 are spacedly mounted on the respective wheels, the latter will not heat up when subjected to braking. The diameter of ball bearing assembly 3 should be at least equal to the distance between two transversely-opposite wheels 21, but at the most equal to the length of the bogie frame tubing members 5.

Only one brake disc 36 may be provided for each wheel instead of two if found sufficient.

Figure 10:
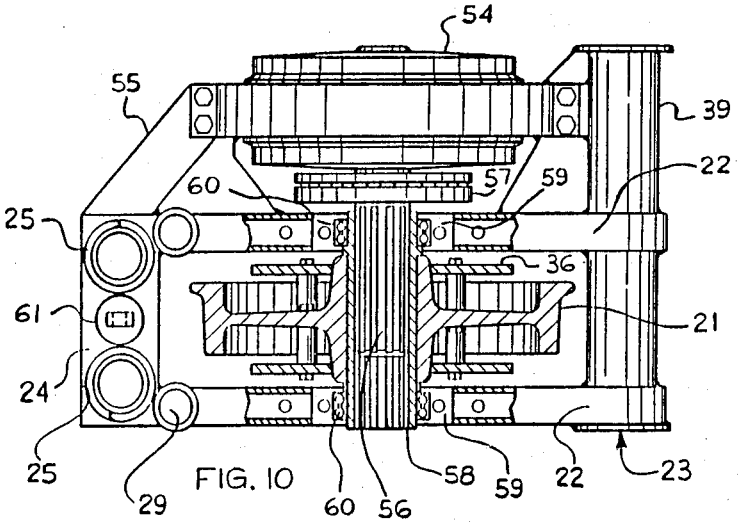
FIG. 10 is a plan view, partially in plan section, of a wheel with its suspension assembly and provided with its own driving motor.

As shown in the alternate embodiment of FIG. 10, each wheel 21 may be driven by its individual drive motor 54, which is in this case fixed to a modified brace 55 replacing the brace 40 of the first embodiment. The rotor motor 54 drives a splined axle 56 through a flexible coupling 57. The splined axle 56 slidably engages an inwardly-splined sleeve 58, which is rotatable in pillow boxes 59 carried by the lever arms 22 through the intermediary of double ball bearings 60 on each side of the driven wheel 21, the latter being keyed to the sleeve 58. FIG. 8 shows the inwardly-splined sleeve 58.

FIG. 10 also shows that a shock-absorber assembly 61 may be mounted on the two suspension coil springs 25, in which case the assembly of the stops 28 and 29 would be mounted radially inwardly of the coil springs, as shown by the rubber bumper 29.

Figure 11:
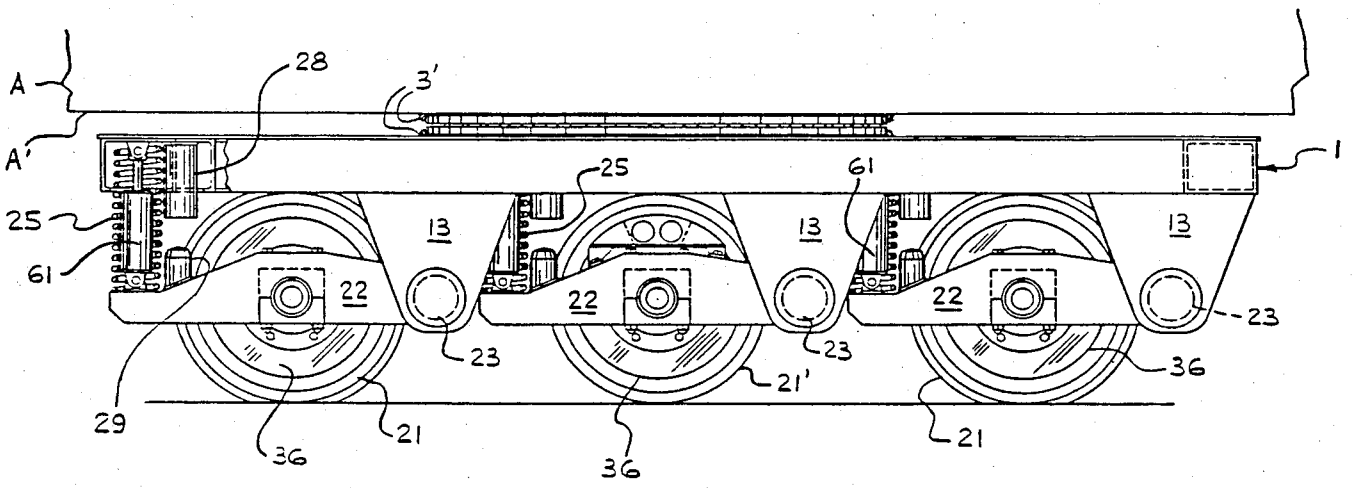
FIG. 11 is a side elevation of a six-wheel bogie in accordance with the invention.
Figure 12:
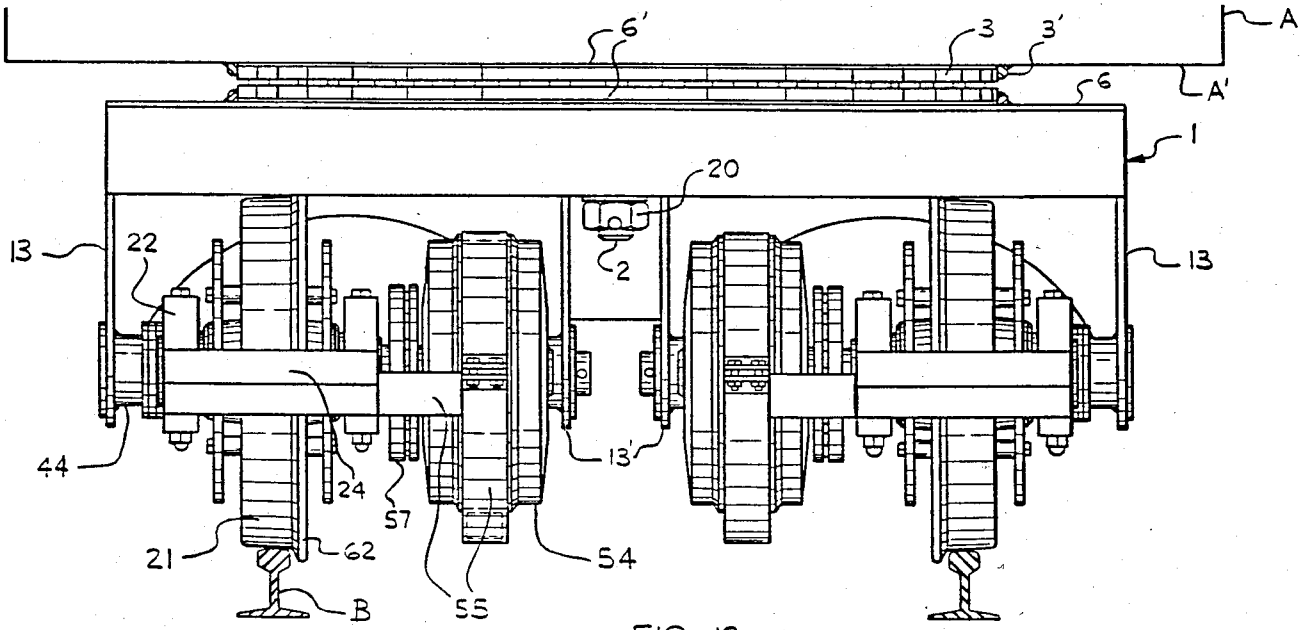
FIG. 12 is a left end elevation of the bogie of FIG. 11.
Figure 13:
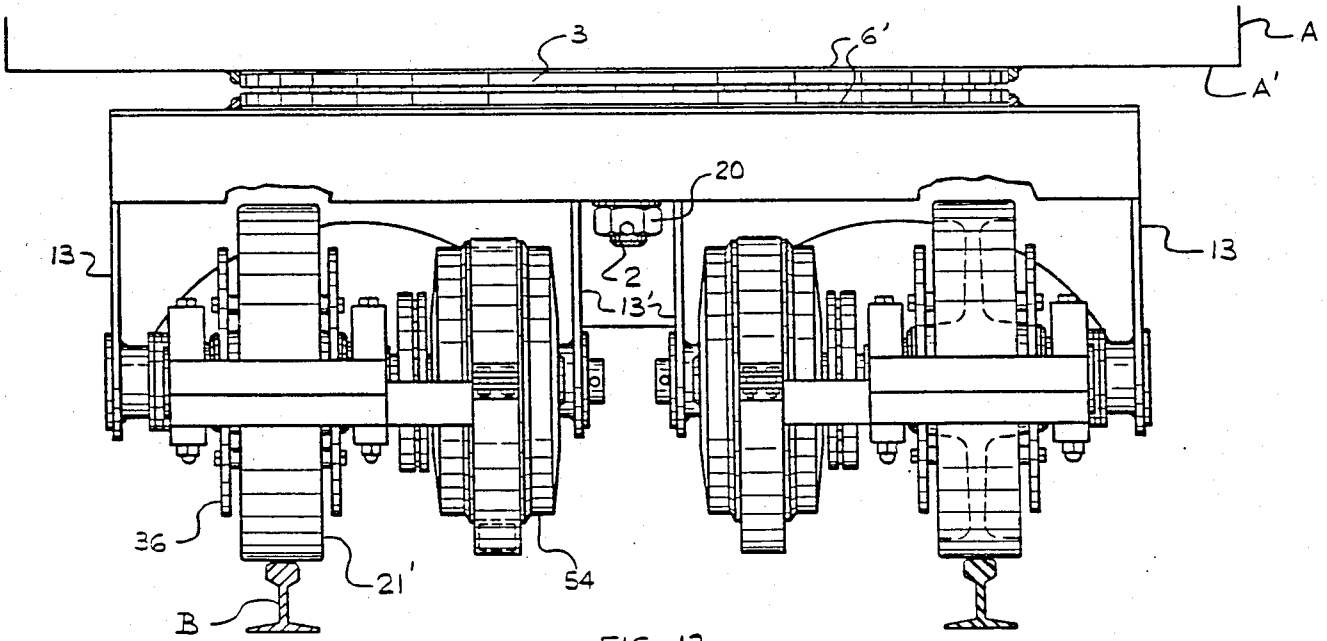
FIG. 13 is a view similar to that of FIG. 12 but showing the middle wheels of the six-wheel bogie.

FIGS. 11, 12, and 13 show yet another embodiment of the invention embodying all of the above-noted characteristics and structure but applied to a six-wheel bogie, in which case the center pair of wheels 21' would be without any of the external guiding flanges 62 of the outer pairs of wheels to better negotiate rail curves. Providing the shock absorber 61 will provide still a smoother ride and especially applicable to passenger railway cars.

Here again, all of the wheels 21 may be driven by its own driving motor 54, normally an electric motor.

What I claim is:

1. A bogie for use with a railway wagon, comprising a rigid horizontally-disposed frame, of generally rectangular shape, a pivot upstanding from the center portion of said frame for pivotal connection to the underside of a wagon, a large diameter bearing assembly carried by said frame on the top thereof and substantially co-axial with said pivot and adapted to engage the underside of said wagon to restrain rotation of said frame in a plane generally parallel to said wagon underside, rail-engaging wheels disposed below said frame for supporting said wagon through said frame, and separate suspension means for each of said wheels interconnecting each wheel to said frame, so that each wheel is movable along a generally vertical plane independently of the other wheel; each wheel having a generally horizontal axle with ends protruding from each side thereof; and said frame comprising for each wheel a pair of spaced opposite support means downwardly projecting from said frame, each suspension means comprising a pair of lever arms, one lever arm extending on each side of a wheel, said lever arms pivotally carrying at their intermediate portion the respective axle ends and pivoted to said support means at one end, a cross-member rigidly interconnecting the opposite ends of said lever arms and disposed beyond said wheel with respect to said one end of said lever arms, and elastic suspension members generally vertically extending between said frame and said cross-member and having a resultant force generally in the vertical plane of said wheel and wherein the distance between said cross-member and the pivotal axis of said lever arms to said support means is about twice that of the wheel axle to said last-named pivotal axis.

2. The bogie as defined in claim 1, wherein said elastic suspension member includes at least one compression coil spring and at least one shock absorber, the latter extending between and connected to said frame and to said cross-member.

3. The bogie as defined in claim 1, including at least six wheels disposed in transversely-extending pairs, with the wheels of the outer pairs being provided at their periphery with a rail-engaging guiding flange and with the wheels of the center pair being devoid of a guiding flange.

4. The bogie as defined in claim 1, wherein said frame is made of welded tubular construction and including stiffening and reinforcing steel plates welded to said tubular construction, said lever arms and said cross-member also of tubular construction.

5. The bogie as defined in claim 1, wherein the wheels are arranged in transversely opposite pairs and the diameter of said bearing assembly is at the most equal to the width of said bogie frame and at the least equal to the distance between the wheels of each pair of wheels.

6. The bogie as defined in claim 1, further including a rigid strut forwardly projecting from the front edge of said bogie frame, and a biasing member downwardly dependent from the front end of the railway wagon underside and engaged by the free end of said rigid strut and designed to bias said rigid strut and therefore said bogie frame in longitudinal alignment with the railway wagon.

7. The bogie as defined in claim 1, wherein said elastic suspension members include a pair of compression coil springs, of similar compression force, and each respectively bearing against said cross-member in the vertical plane of the respective lever arms.

8. The bogie as defined in claim 7, wherein each wheel carries a brake disc, said brake disc being spacedly fixed to the respective wheel and in a plane parallel to that of said wheel.

9. A bogie for use with a railway wagon, comprising a rigid horizontally-disposed frame, of generally rectangular shape, a pivot upstanding from the center portion of said frame for pivotal connection to the underside of a wagon, a large diameter bearing assembly carried by said frame on the top thereof and substantially co-axial with said pivot and adapted to engage the underside of said wagon to restrain rotation of said frame in a plane generally parallel to said wagon underside, rail-engaging wheels disposed below said frame for supporting said wagon through said frame, and separate suspension means for each of said wheels interconnecting each wheel to said frame, so that each wheel is movable along a generally vertical plane independently of the other wheel; each wheel having a generally horizontal axle with ends protruding from each side thereof; and said frame comprising for each wheel a pair of spaced opposite support means downwardly projecting from said frame, each suspension means comprising a pair of lever arms, one lever arm extending on each side of a wheel, said lever arms pivotally carrying at their intermediate portion the respective axle ends and pivoted to said support means at one end, a cross-member rigidly interconnecting the opposite ends of said lever arms and disposed beyond said wheel with respect to said one end of said lever arms, and elastic suspension members generally vertically extending between said frame and said crossmember and having a resultant force generally in the vertical plane of said wheel wherein the pivotal connection of said one end of said lever arms to said support means includes sleeves carried by the opposite support means and in axial register, bushings lining the interior of said sleeves, a tubular pin removably inserted within said bushings and bridging the space between said sleeves, additional bushings surrounding said tubular pin, an outer tube surrounding and resting on said additional bushings, said one end of said lever arms being secured to said outer tube, said outer tube bridging the space between the ends of said sleeves.

10. The bogie as defined in claim 9 further including spacer washers surrounding said tubular pin and disposed between the ends of said outer tube and the associated sleeves, respectively, said washers being of adjusted thickness, so as to longitudinally align the respective wheels by axially shifting said outer tube along said tubular pin.

11. A bogie as defined in claim 9 wherein the distance between said sleeves is greater than the distance between said two levers arms, and one of said lever arms is secured to one end of said outer tube, adjacent a sleeve and further including a brace member joining the opposite end of said outer tube to the other one of said lever arms.

12. The bogie as defined in claim 11 further including a drive motor carried by said brace and drivingly connected to the wheel mounted between the lever arms associated with said brace.

* * * * *